US006361824B1

(12) United States Patent
Yekimov et al.

(10) Patent No.: US 6,361,824 B1
(45) Date of Patent: Mar. 26, 2002

(54) PROCESS FOR PROVIDING A HIGHLY REFLECTIVE COATING TO THE INTERIOR WALLS OF MICROCHANNELS

(75) Inventors: Aleksey Yekimov, Briarcliff Manor; Vishal Chhabra, Ossining, both of NY (US)

(73) Assignee: Nanocrystal Imaging Corp., Briarcliff Manor, NY (US)

( * ) Notice: Subject to any disclaimer, the term of this patent is extended or adjusted under 35 U.S.C. 154(b) by 0 days.

(21) Appl. No.: 09/628,570

(22) Filed: Jul. 31, 2000

(51) Int. Cl.[7] ..... B05D 1/18; B05D 5/12; B05D 7/22

(52) U.S. Cl. ..... 427/125; 427/97; 427/98; 427/230; 427/238; 427/294; 427/430.1; 427/437; 427/443.1

(58) Field of Search ..... 427/125, 430.1, 427/437, 443.1, 97, 98, 230, 238, 294

(56) References Cited

U.S. PATENT DOCUMENTS 3,776,740 A * 12/1973 Sivertz et al. ..... 106/1
4,102,702 A * 7/1978 Bahls ..... 106/1.23
4,550,036 A * 10/1985 Ludwig et al. ..... 427/443.1
4,815,854 A * 3/1989 Tanaka et al. ..... 356/356
5,080,929 A * 1/1992 Zachman et al. ..... 427/97
5,418,833 A * 5/1995 Logan ..... 378/154
5,562,838 A * 10/1996 Wojnarowski et al. ..... 216/24
5,949,850 A * 9/1999 Tang ..... 378/154
6,030,632 A * 2/2000 Sawan et al. ..... 424/405
6,224,983 B1 5/2001 Sodervall et al. ..... 428/461

* cited by examiner

*Primary Examiner*—Michael Barr
(74) *Attorney, Agent, or Firm*—William L. Botjer

(57) ABSTRACT

Methodology for providing a smooth, thin, highly reflective coating to the walls of microchannels disposed in a plate or substrate. Such plates are commonly used in image intensifiers and have more recently been used to provide high resolution X-ray imaging screens. In the process silver nitrate solution is reacted so as to provide a silver amine complex. In a first embodiment of the process, the microchannel plates are disposed vertically in a beaker and immersed, without stirring, in a solution including the silver amine complex and a reducing agent. In a second embodiment of the process, a fluid flow of filtered reactant is directed through the microchannels. In each embodiment the walls of the microchannels become plated with a highly reflective (>90%), thin (20–50nm) and smooth coating of metallic silver.

20 Claims, 1 Drawing Sheet

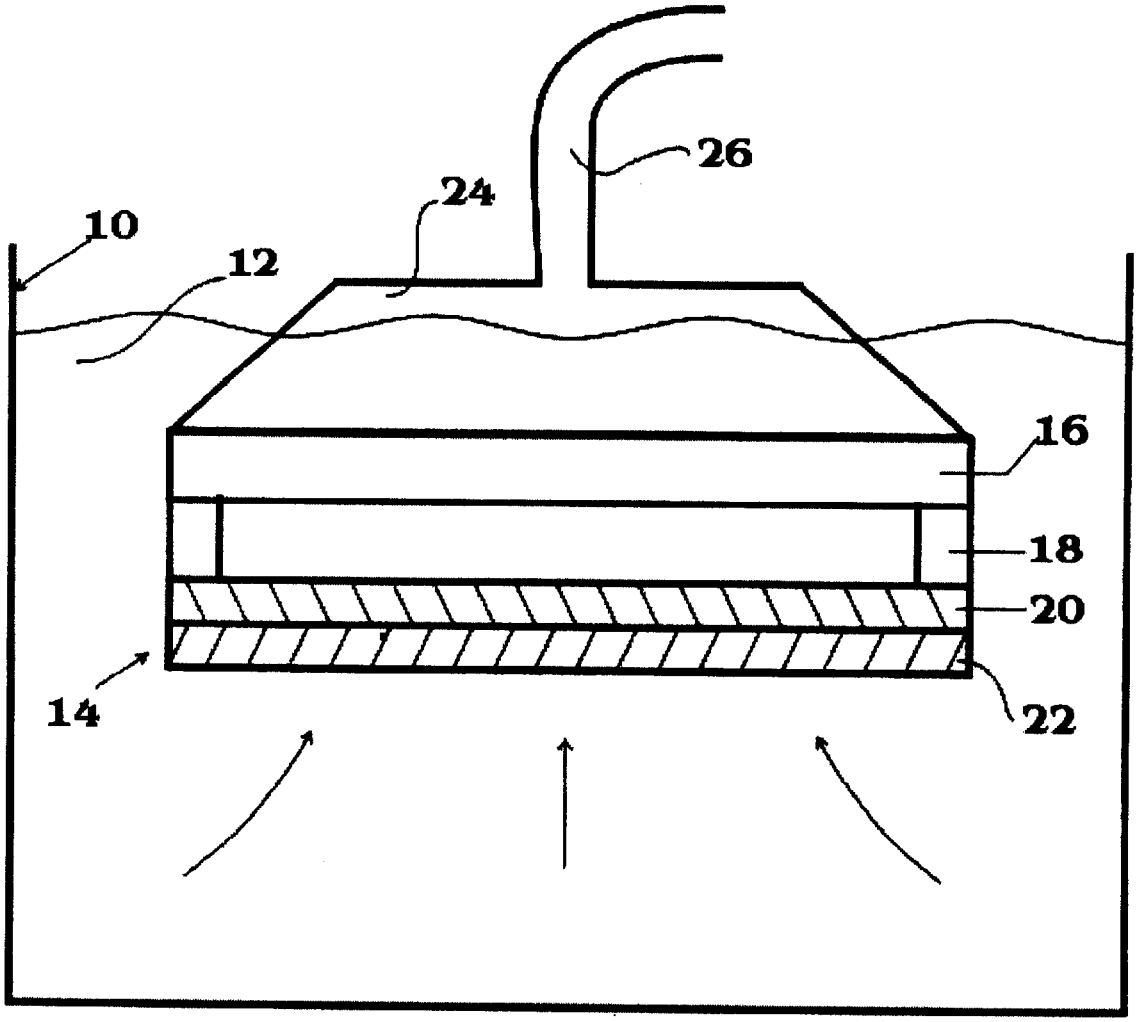
26
24
10
12
16
18
20
14
22

PROCESS FOR PROVIDING A HIGHLY REFLECTIVE COATING TO THE INTERIOR WALLS OF MICROCHANNELS

BACKGROUND AND SUMMARY OF THE INVENTION

This application is directed to a methodology for the manufacture of microchannel plates used for converting radiation, such as X-rays, into visible light. More particularly this invention is directed to a methodology for providing a smooth, thin, highly reflective coating to the walls of microchannels disposed in a plate or substrate. Such plates are commonly used in image intensifiers and have more recently been used to provide high resolution X-ray imaging screens.

The use of microchannel plates for high resolution X-ray imaging is described in detail in U.S. Pat. No. 5,952,665 Issued Sep. 14, 1999 and entitled "Composite Nanophosphor Screen for Detecting Radiation". These plates are also described in U.S. patent application Ser. No. 09/197,248 filed Nov. 20, 1998 Entitled "Composite Nanophosphor Screen For Detecting Radiation Having Optically Reflective Coatings" and U.S. patent application Ser. No. 09/385,995 filed Aug. 30, 1999 Entitled "Microchannel High Resolution X-ray Sensor Having an Integrated Photomultiplier". The disclosures of these patents and applications are hereby incorporated by reference as if fully set forth herein. Microchannel plates are also used in photomultipliers and other scientific applications.

The microchannel plates used in these applications comprise a substrate which can be silicon, glass or metal which include a multiplicity of microchannels extending between the upper and lower surfaces of the substrate. The microchannels have diameters from 100 nanometers to 40 microns and are of 50–1000 microns in length so that their aspect ratios (the ratio of diameter to length) of from 2.5:1 to 10000:1. The walls of the microchannels are arranged to reflect light down the microchannels to suitable light collecting device such as film or an electronic device.

In order to maximize the light output from the microchannels it has been found that the application of a highly reflective coating to the walls of the microchannels is desirable. However, the application of a reflective coating to high aspect ratio microchannel is difficult. The coating to be applied must be: 1) homogeneous, that is it must have equal thickness throughout the length of the microchannel 2) thin (20–50 nm) so that it does not block or unduly decrease the diameter of the microchannel and to permit multiple coatings to be applied to increase the reflectivity 3) highly reflective to decrease diffusion scattering and to provide mirror like reflectivity and 4) smooth. The process used to apply the coating must not harm the substrate or leave any byproducts in the microchannels.

The technology has developed a number of methodologies for application of thin film coatings to substrates which have been found to be problematic, at best when used to coat the interior walls of microchannels. Among the techniques tried to provide a reflective coating on the interior walls of the microchannels were: Chemical Vapor Deposition (CVD) of silver or aluminum, which did not completely coat the channels as it did not adhere to the interior surface, even with multiple depositions the coating was found to be uneven and thus unuseable. Sputtering, with and without ion assistance was unsuitable as it coated a 300 micron deep channel to a depth of only 50 microns. Furthermore, the coating was tapered to a narrow point. Electrodeless (chemical) coating with nickel was also unsuccessful as the surface produced therewith was seen to be too rough when viewed with an electron microscope. Organic ink was also tried but even after 18 coatings the surface was unacceptable. Finally, in an attempt to improve the smoothness of the coatings applied by the various methodologies, reflowing (heating the coated substrate after deposition) was tried. However this technique was also unsuccessful as the coatings along the walls of the microchannels were still insufficiently smooth.

After realizing that the above described deposition techniques were unsuccessful and would not provide a satisfactory reflective coating in the microchannels meeting the necessary parameters, further research was conducted to determine if there was a coating or deposition technique in a disparate field that could be adapted to the coating of the interior walls of microchannels. It was found that there was a old technique for plating a deposit of silver to form mirrors on glass plates. The technique used a silver nitrate solution, ammonia and potassium hydroxide to form a solution that, when reduced, with a sugar solution left a deposit of metallic silver on glass surfaces when the solution was poured over horizontally disposed glass plate and agitated.

However when the mirror technique was tried on microchannel plates it was not successful as the microchannels became clogged with byproducts of the reaction when the plate was placed in the plating solution. The process had to be modified and adapted so that the microchannels could be plated without reaction byproducts clogging the microchannels. It was found that the microchannel plate must be oriented vertically rather than horizontally in the previous process. Vertical orientation of the plate means that the microchannels to be plated are disposed horizontally. Furthermore it was found that in order for the microchannels to be successfully plated without clogging that both the upper and lower surfaces of the plate be non obstructed and that the solution (and the plate) not be agitated.

In a first embodiment of the plating process suitable for microchannels plates a silver amine complex is prepared and mixed with a reducing solution. The microchannel plate is positioned vertically in the mixed solution without agitation to deposit a coating of metallic silver on the upper and lower surfaces and evenly within the walls of the microchannels. The process of the first embodiment is particularly suitable for the plating of microchannels that have a diameter such that the volume of plating solution contained within the microchannel itself is sufficient to provide enough silver to coat the walls to a high degree of reflectivity. In this process such microchannels are generally those with a diameter on the order of 14 microns or greater as they have a sufficiently high surface to volume ratio. However the first embodiment of this process may also be used for plating microchannels of less than 14 microns in diameter if the plate itself is thin, i.e. on the order of 100 microns or less. It is theorized that this occurs because diffusion from outside the microchannel permits sufficient silver to diffuse into the microchannels to obtain a highly reflective coating. This process was successful in plating 10 micron diameter microchannels extending between the upper and lower surfaces of a 100 micron thick plate to a measured reflectivity of 93% (at a wavelength of measurement of 632.8 nm), which is very close to the practical maximum reflectivity of 94%. However when the thickness of the plate was increased (with the same size microchannels) it was found that the reflectivity of the plating decreased.

In order to provide for the plating of thicker plates a second embodiment of the process was developed. In the second embodiment the same silver amine and reducing solution is used with a vacuum utilized to provide a fluid flow through the microchannels which provides an increased supply of metallic silver to the microchannels for plating. In order to prevent clogging of the microchannels with reaction byproducts, a filter is positioned upstream of the microchannels to prevent any byproducts from entering the microchannels. The second embodiment of the process is suitable for use with both thick and thin plates having high and low aspect ratio microchannels, has a high degree of repeatability and is very efficient in its use of the silver contained in the solution.

BRIEF DESCRIPTION OF THE DRAWING

For a better understanding of the invention, reference is made to the following drawing which are to be taken in conjunction with the detailed description to follow in which:

The drawing illustrates how the second embodiment of the inventive process for coating the walls of the microchannel of a microchannel plate is carried out.

DETAILED DESCRIPTION OF THE PREFERRED EMBODIMENTS

The steps of a representative example of the first embodiment of the process for coating a substrate having microchannels are as follows:

1) In the process 11.5 grams of silver nitrate $AgNO_3$ were dissolved in 120 milliliters of distilled water.

2) To the solution prepared in step 1 is added approximately 20 ml of a 20% ammonium hydroxide ($NH_4OH$) solution until the combined solution becomes clear.

3) To the solution of step 2 is added, in a dropwise manner, a further solution of 1.4 grams of $AgNO_3$ in 10 ml of deionized water until the combined solution becomes a yellow color. The solution of 1.4 grams of $AgNO_3$ in 10 ml of deionized water is a "stock solution" and a portion of it is set aside for later use.

4) To the solution of step 3 is added, in a dropwise manner, a solution of potassium hydroxide comprising 7.5 grams KOH in 120 ml water until the combined solution becomes a dark (black or brown) color. This solution should be treated with care as it is light sensitive and, when kept for an extended period in light, can form potentially explosive "gun silver", silver fulminate.

5) To the solution of step 4 is added is a further amount of a 20% $NH_4OH$ solution until the combined solution becomes clear.

6) To the solution of step 5 is added dropwise, without stirring, the stock silver nitrate solution set aside in step 3. A brown precipitate will form and settle. This solution, which is a silver amine complex (also referred to as a silver ammoniacal compound or "Tollens reagent") should be filtered to remove the precipitate and forms the silver bearing compound for coating the microchannels.

7) A solution of 7.5 grams of dextrose in 60 ml of distilled water forms a reducing agent for the silver amine complex. Alternatively a mixture of standard sugar (sucrose) mixed with concentrated nitric acid ($HNO_3$), boiled and cooled to form "invert sugar" can be used as the reducing agent.

8) The microchannel substrate to be coated should be placed vertically (that is with the microchannels being disposed horizontally) in a beaker such that both the upper and lower surfaces are open to fluid flow (both ends of the microchannels should be unblocked).

9) The silver amine complex of step 6 and the reducing solution of step 7 are mixed and added to the microchannel plate beaker without stirring to form a plating solution. The microchannel plate can remain in the solution for 1–5 minutes. Thereafter the microchannel plate is removed, rinsed and sonicated in water and dried in an oven. The microchannel plate can also be washed with isopropanol and dried in a vacuum.

10) The above steps will provide a smooth, uniform, thin (30–50 nm) coating of metallic silver along the entire interior walls of the microchannels as well as on the upper and lower surfaces of the substrate. It is noted that the quantities and volumes described above are exemplary only and are to be adjusted depending on the quantity of plating solution required.

The basic reactions of this process are, Silver nitrate is reacted with a compound having a strong $OH^-$ (hydroxide) group, such as sodium hydroxide and/or potassium hydroxide to form silver oxide with sodium nitrate and water as byproducts:

$$2AgNO_3+2KOH>Ag_2O+KNO_3+H_2O$$

The silver oxide is reacted with ammonia and water to provide a silver amine complex:

$$Ag_2O+4NH_3+H_2O>2Ag(NH_3)_2OH$$

The silver amine complex is reacted with the dextrose formed by the reaction of table sugar and acid which contains an aldehyde group (CHO) which will reduce the silver amine complex to provide free metallic silver which will coat the walls of the microchannels:

$$Ag(NH_3)_2OH+R(CHO)>2Ag+RCOONH_4+3NH_3+H_2O$$

The choice of a reducing agent is not critical any number of aldehyde group containing compounds may be used. Another compound that has been found effective as a reducing agent for silver oxide is "Rochelle salt" potassium sodium tartate ($C_4H_4O_6$—$4H_2O$).

The process of the first embodiment is particularly suitable for the plating of microchannels that have a diameter such that the volume of plating solution contained within the microchannel itself is sufficient to provide enough silver to coat the walls to a high degree of reflectivity. For this process such microchannels are generally those with a diameter on the order of 14 microns or greater as they have a sufficiently high volume to surface ratio. However this process may also be used for plating microchannels of less than 14 microns in diameter if the plate itself is thin, i.e. on the order of 100 microns or less. It is theorized that this occurs because diffusion from outside the microchannels will permit sufficient silver to diffuse into the microchannels to obtain a highly reflective coating. By way of example, the process of the first embodiment was successful in plating 10 micron diameter microchannels extending between the upper and lower surfaces of a 100 micron thick plate to a measured reflectivity of 93% (at a wavelength of measurement of 632.8 nm), which is very close to the practical maximum reflectivity of 94%. A 115 micron thick plate with 10 micron microchannels had a reflectivity of 90% but a 300 micron plate had a reflectivity of 70% indicating a falloff in reflectivity with increased plate thickness (although multiple coatings could be used to improve reflectivity).

In order to provide for the repeatable plating of thicker plates a second embodiment of the process was developed. In the second embodiment the same silver amine and reducing solution is used with a vacuum utilized to provide a fluid flow through the microchannels which provides an increased supply of silver molecules to the microchannels for plating. In order to prevent clogging of the microchannels with reaction byproducts, a filter is positioned upstream of the microchannels to prevent any byproducts from entering the microchannels. The second embodiment of the process is not limited by the thickness of the plates (i.e. it is suitable for use with both thick and thin plates) having high and low aspect ratio microchannels, is rapid, has a high degree of repeatability and is very efficient in its use of the silver contained in the plating solution.

The drawing illustrates how the second embodiment is carried out, a beaker 10 holds the silver amine complex/reducing "plating" solution 12, described in detail above. Positioned within beaker 10 and solution 12 is an assembly 14 for holding the microchannel plate 16 to be coated. Assembly 14 includes a spacer ring 18 to which is mounted a support grid 20 and a filter 22 having 1–3 micron diameter pores. Disposed on the other side of microchannel plate 16 is a hood 24 which is attached to a vacuum line 26 which in turn is attached to a source of vacuum (not shown) which is used to provide a flow of solution 12 through the microchannels of microchannel plate 16. In operation solution 12 will flow though filter 22 where any reaction byproducts will be removed and thereafter through the microchannels of plate 16 where metallic silver will be deposited along the walls of the individual microchannels.

Support grid 20 may be in the form of a metal or plastic grid which simply serves to provide mechanical support to filter 22 so that it will not deform under pressure, filter 22 is a standard laboratory filter used in many chemical processes that require filtering. The amount of vacuum applied is not critical as all that is required is sufficient vacuum to cause the plating solution to flow through filter 22 and the microchannels of plate 16 so that metallic silver will be deposited along the walls of the individual microchannels. Apparatus other than a vacuum pump, capable of providing the necessary liquid flow, can also be used. Under a vacuum of ½ atmosphere the plating process will be completed in approximately 30 seconds to 5 minutes at room temperature. While only a single microchannel plate is illustrated in the drawing it is to be understood that multiple plates could easily be simultaneously coated in a suitable assembly.

Either of the above described processes is capable of depositing, in a single step, a silver coating to the walls of microchannels with a measured reflectivity of 93% which is very close to the practical maximum reflectivity of 94%. These reflectivities were measured in the microchannels with a Helium Neon (HeNe) laser at a wavelength of 632.8 nm. The coating applied by the above described processes has been found to be tough in that it remained intact even when heated to 400° C. in a nitrogen atmosphere. This means that the plate may be further processed without adversely affecting the reflectivity of the coating.

The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A method for providing a reflective coating to the walls of a multiplicity of microchannels having diameters of less than 40 microns disposed in a substrate comprising the steps of:

providing a silver amine complex;

providing a solution that will reduce the silver amine complex;

positioning the substrate to be coated vertically within a beaker;

mixing the silver amine complex with the reducing solution and immersing the substrate to be coated within the mixed solution to deposit a coating of silver within the walls of the microchannels.

2. The method of claim 1 wherein the silver amine complex comprises $Ag(NH_3)_2OH$.

3. The method of claim 2 wherein the silver amine complex is formed from a mixture of silver oxide and ammonia.

4. The method of claim 3 wherein the silver oxide is formed by the reaction of silver nitrate with a hydroxide compound.

5. The method of claim 4 wherein the hydroxide compound comprises at least one of ammonium hydroxide and potassium hydroxide.

6. The method of claim 1 wherein the reducing solution comprises an aldehyde group.

7. The method of claim 1 wherein the reducing solution comprises an invert sugar solution.

8. The method of claim 1 wherein the reducing solution comprises dextrose in distilled water.

9. The method of claim 1 wherein the reducing solution comprises potassium sodium tartrate.

10. A method for providing a reflective coating to the walls of a multiplicity of microchannels having diameters of less than 40 microns disposed in a substrate comprising the steps of:

converting silver nitrate solution into a silver amine complex;

providing a solution that will reduce the silver amine complex;

positioning the substrate to be coated vertically within a beaker;

mixing the silver amine complex with the reducing solution and immersing the substrate to be coated within the mixed solution to deposit a coating of silver within the walls of the microchannels.

11. The method of claim 10 wherein the silver nitrate solution is converted into a silver amine complex by the steps of: a) reacting silver nitrate with a hydroxide to provide silver oxide and b) reacting the silver oxide with an ammonia solution.

12. The method of claim 11 wherein the hydroxide comprises at least one of ammonium hydroxide and potassium hydroxide.

13. The method of claim 10 wherein the reducing solution comprises an aldehyde group.

14. The method of claim 10 wherein the reducing solution comprises at least one of invert sugar, dextrose, and Rochelle salt.

15. A method for providing a reflective coating to the walls of a multiplicity of microchannels having diameters of less than 40 microns disposed in a substrate comprising the steps of:

providing a silver amine complex;

providing a solution that will reduce the silver amine complex;

mixing the silver amine complex with the reducing solution to form a plating solution;

filtering any byproducts formed in the plating solution; and directing the filtered plating solution through the microchannels to deposit a coating of silver on the walls of the microchannels.

16. The method of claim 15 wherein the plating solution is directed through the microchannels by the step of applying a vacuum to the microchannels.

17. The method of claim 15 wherein the step of filtering byproducts formed in the plating solution is accomplished by the step of positioning a filter element proximate to said microchannels.

18. The method of claim 15 wherein the silver amine complex comprises $Ag(NH_3)_2OH$.

19. The method of claim 15 wherein the reducing solution comprises an aldehyde group.

20. The method of claim 15 wherein the reducing solution comprises at least one of invert sugar, dextrose and distilled water, and Rochelle salt.

* * * * *